United States Patent [19]

Cotchonis

[11] Patent Number: 4,521,018

[45] Date of Patent: Jun. 4, 1985

[54] GOLF BALL POSITION MARKER

[76] Inventor: N. Eugene Cotchonis, 14750 Round Valley Dr., Sherman Oaks, Calif. 91403

[21] Appl. No.: 538,666

[22] Filed: Oct. 3, 1983

[51] Int. Cl.[3] ..... A63B 57/00

[52] U.S. Cl. ..... 273/32 A; 273/178 R

[58] Field of Search ..... 273/177 R, 178 R, 183 A, 273/32 B, 183 C, 32 A, 183 D, 162 E

[56] References Cited

U.S. PATENT DOCUMENTS

| | | | |
|---|---|---|---|
| 1,094,236 | 4/1914 | Minshall | 273/178 R |
| 1,676,975 | 7/1928 | Anderson et al. | 273/177 R |
| 3,081,090 | 3/1963 | Congleton | 273/177 R X |
| 3,310,879 | 3/1967 | Brzezinski et al. | 273/32 B X |
| 3,424,464 | 1/1969 | Greenhouse | 273/178 R |
| 3,490,769 | 1/1970 | Torbett | 273/178 R X |
| 3,837,653 | 9/1974 | Fox et al. | 273/178 R |
| 4,280,698 | 7/1981 | Troiano | 273/178 R |

FOREIGN PATENT DOCUMENTS

| | | | |
|---|---|---|---|
| 220377 | 8/1924 | United Kingdom | 273/178 R |

*Primary Examiner*—George J. Marlo
*Attorney, Agent, or Firm*—Herbert E. Haynes, Jr.

[57] ABSTRACT

A marker for marking the position of a golf ball that is to be lifted from the surface of a putting green. The marker includes a thin gage planar body which defines an opening of at least semi-circular configuration which opens onto one edge of the planar body, and which is sized so that the marker can be dropped vertically over the golf ball onto the surface of the putting green.

1 Claim, 4 Drawing Figures

GOLF BALL POSITION MARKER

BACKGROUND OF THE INVENTION

1. Field of the Invention

This invention relates generally to the game of golf and more particularly to a device for marking the location of a golf ball that is to be lifted off of the surface of a putting green.

2. Description of the Prior Art

The rules of the game of golf allow a golf ball to be lifted from the surface of a putting green for cleaning of the ball and to keep it from being a distraction or an obstruction to other golfers. Such a lifted ball must be marked to insure that when it is replaced it will be returned to the same spot from which it was lifted. Not only do the rules of golf permit such ball removal, it is a common practice, and courtesy for a golfer to remove and mark a ball and replace it when it becomes his turn to putt. The golf rules specify that a ball marker be placed immediately behind the ball and that in the event that such a marker should interfere with the play, stance or stroke of another golfer, it should be placed one or more putter head lengths to one side.

As a result of these rules and the etiquette, many golfers carry a ball marker in their pocket and some simply employ a coin, such as a dime, for this purpose. Many specialized ball markers have been suggested and used. However, the most common ball marker being used is a disc about the size of a dime with a peg, or prong, extending axially from one of the planar surfaces of the disc-shaped body. This type of marker is shown and described in U.S. Pat. Nos. 3,622,157 and 3,895,797.

In using a ball marker of the type described immediately above, a golfer laterally moves the marker to a position proximate and at least partially under the ball to insure that he does not violate the provisions of the rules relating to placing the marker immediately behind the ball. When in this position, the golfer presses down on the ball marker to cause the peg to penetrate the surface of the putting green and thereby positively locate the marker. This same basic marker locating technique is employed when a coin is used, and even though the coin does not have an axial peg, most golfers will press the coin down into the grass to make sure that it is lying flat and that it won't be moved by the grass or present an obstruction should another golfer's ball pass over the marker when it is being putted.

Other ball markers of this same general type have been suggested, such as in U.S. Pat. No. D. 233,897, U.S. Pat. Nos. 1,735,736 and 2,107,944.

There are several shortcomings of the above described prior art ball markers. Although these ball markers can, if carefully placed, mark the ball with regard to the in-line distances from the hole with a fair degree of accuracy, they do depend on the care taken by the golfer, and they do not make provisions for clearly defining the lateral disposition of the ball. Most of the time this does not represent a problem, however, golfers have been known to unintentionally, and in some instances intentionally, advance or laterally relocate the ball an inch or more when replacing it to improve the lie of the ball, take advantage of a more favorable putting surface contour, or the like. Such moving, whether intentional or unintentional, can result in a two-stroke penalty.

Another problem associated with the prior art ball markers results from the manner in which they are placed, and subsequently removed from, immediately behind the ball. In order to properly accomplish such placement and removal, the marker must be moved laterally toward and at least partially under the ball as hereinbefore mentioned. Should the ball marker, the golfer's fingers or hand hit the ball and cause it to move, a one-stroke penalty is imposed.

The rules of golf etiquette calls for golfers, or caddies, to avoid walking on the "line" of a golf ball to be putted. The "line" is imaginary and is considered to be the line between the ball and the hole into which the ball is to be putted. The reason for this is that the weight of a golfer will cause a depression in the putting surface which could deflect a putted golf ball from its intended path. Such depressions will disappear eventually due to the inherent resiliency of the soil and the grass, but they do not return to normal for some time as determined by the condition, or state of the green, depth of the depression, and the like. All knowledgable golfers are very careful not to walk in the line of a golf ball, but sometimes it happens unintentionally simply because they failed to see the ball marker due to its size. Such depressions, although smaller, are also formed when a golfer presses down on the ball marker to imbed the peg in the green or to flatten a coin-type marker. These forces exerted on the ball marker can result in a depression which will last for about 10 minutes or more depending on the amount of force exerted and the condition of the putting green.

The prior art ball markers are easy to lose, difficult to find amongst the coins in a golfer's pocket, and have other problems due to their size. One shortcoming is the relatively low visibility factor of the prior art golf ball markers. Most golfers spend some time looking from various locations at the ball, its position relative to the hole, the line, and the like, in an attempt to determine just what to do when they putt. Such lining-up, reading the green, and otherwise looking over the situation is very difficult, and in many instances impossible, to do from a distance while others are putting due to the low visibility factor of the prior art ball markers. This results in delays in the game, in that most of the time, the golfer must wait until he has replaced his ball before he can begin lining-up his putt.

In tournament play, mostly on a professional level, most people in the gallery and television camaras cannot see the prior art ball markers which can be annoying to avid fans and can cause problems for the announcers. Unless an announcer happened to see the ball before it was removed and marked, and remembers its location, he cannot report the lie, distances or other circumstances concerning a ball to be putted until after it has been replaced. And, the T.V. audience cannot see the prior art ball markers at all.

In most instances, the prior art golf ball markers are distributed free as promotional devices to advertise the products or services of the companies which distribute the markers. Due to the relatively small size of the prior art markers, they cannot realistically be considered as an effective advertising medium and therefore, they are not very attractive to some companies which might otherwise be interested.

Therefore, a need exists for a new and improved golf ball marker which overcomes some of the problems and shortcomings of the prior art.

SUMMARY OF THE INVENTION

In accordance with the present invention, a new and improved golf ball marker is disclosed which is in the form of a relatively thin gage planar sheet of suitable material, which is provided with an opening preferably at least of semi-circular configuration and preferably larger to form the sector of a circle which opens onto one edge of the planar sheet. The two radii which define the sector of the circle opening are each somwhat larger than the radius of a standard golf ball so that the marker can be vertically dropped over a ball to be marked onto the surface of the putting green rather than be laterally moved into a position partially under the ball as is the case in all prior art ball markers known to me.

The ball marker of the present invention used in the above described manner positively marks the exact location of the golf ball as being at the center of the sector of the opening defined by the planar sheet. Thus, not only is the in-line putting distance positively marked, but the lateral position is also clearly defined. Such positive spot marking makes it difficult for a golfer to improperly relocate his ball either intentionally or unintentionally. Also, the chances of the ball being accidentally displaced by a golfer's hands or fingers is substantially reduced if not eliminated in that the golfer can see what he is doing rather than being required to push the ball marker underneath the ball.

Due to the relatively large size of the ball marker of the instant invention, no ground penetrating peg is required and it will inherently lie flat on the green and be stable due to the relatively large surface area of the marker which is in bearing engagement with the surface of the putting green. Therefore, no pushing down forces need be applied by the golfer.

The other shortcomings of the prior art due to their relatively small size, as hereinbefore discussed, are overcome by the present invention due to the relatively high visibility factor thereof. The golfer himself can readily see his marker from various distances and locations about the green allowing him to line-up his putt while other golfers are putting and other golfers, fans in the gallery, T.V. announcers, and even T.V. viewers can see the relatively larger golf ball markers. Further, more space is available for advertising or other indicia such as identification of the owner, special event commemorating indicia, and the like.

Accordingly, it is an object of the present invention to provide a new and useful golf ball marker.

Another object of the present invention is to provide a new and useful golf ball marker for defining the in-line distance of a golf ball from the hole into which it is to be putted and marking the lateral position of the ball relative to the in-line distance.

Another object of the present invention is to provide a new and useful golf ball marker which is configured to be dropped vertically over a golf ball onto the surface of a putting green to minimize unintentional movement of the golf ball to be lifted during marking of its position.

Another object of the present invention is to provide a new and useful golf ball marker which is larger than the prior art markers to increase the visibility factor thereof.

Still another object of the present invention is to provide a golf ball marker of the above described character which includes a thin-gage sheet of planar material which is configured to define an opening which is slightly larger than a golf ball.

Yet another object of the present invention is to provide a golf ball marker of the above described character wherein the planar sheet of material is configured to define the opening as being the sector of a circle whose intercepted arc contains an angle of at least 180°.

The foregoing and other objects of the present invention as well as the invention itself, may be more fully understood from the following description when read in conjunction with the accompanying drawings.

DESCRIPTION OF THE PREFERRED EMBODIMENTS

Figure 1:
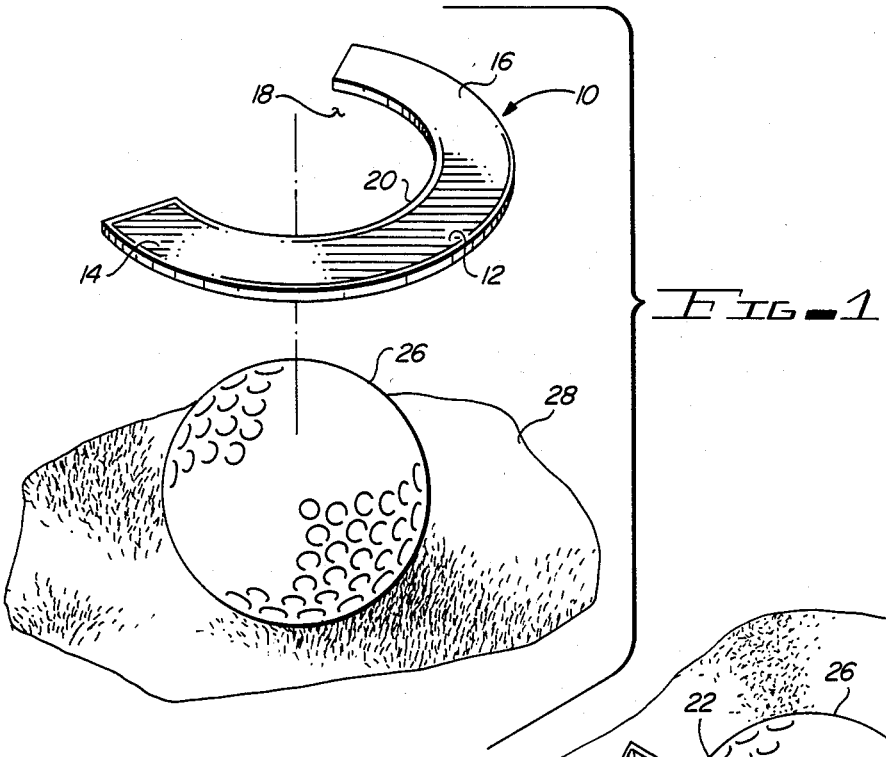
FIG. 1 is a perspective view of a golf ball lying on a putting surface with the golf ball marker of the present invention being shown in vertically exploded relationship thereto.
Figure 2:
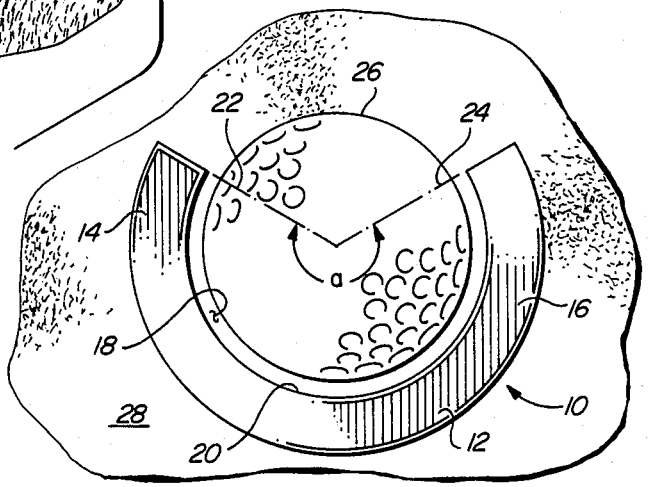
FIG. 2 is a plan view of the golf ball marker in its ball marking position relative to the golf ball.
Figure 3:
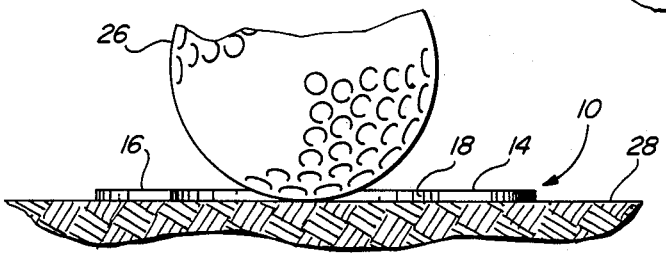
FIG. 3 is a fragmentary elevational view of the golf ball marker in its ball marking position relative to the golf ball.

Referring more particularly to the drawings, FIGS. 1, 2 and 3 show the preferred embodiment of the golf ball marker of the present invention, with the marker being identified in its entirety by the reference numeral 10.

The golf ball position marker 10 is formed of sheet material, such as metal, synthetic resin, or the like, with the material being of relatively thin gage to form a marker body of planar configuration which presents minimal obstruction to a rolling golf ball in the event that it should pass over the marker 10.

The marker body 10 is preferably in the general shape of a horseshoe and thus has a bight portion 12 with a spaced pair of extending arms 14 and 16. The bight and arm portions 12,14 and 16 circumscribe an opening 18 which is a part of a circle of at least semi-circular configuration and is preferably a sector of a circle having an intercepted arc 20 which contains an angle a of over 180° between the two radii 22 and 24. The two radii are each of greater length than the radius of a golf ball 26 so that the marker 10 can be dropped vertically over the golf ball onto the putting surface 28 in the manner shown best in FIG. 1, and as will hereinafter be described in detail.

It will be understood that the marker 10 could be configured to define the opening 18 as being the sector of a circle with the intercepted arc 20 containing 180° or less. However, if this were the case, the marker could possibly be dropped somewhat behind rather than actually over the ball and the marker spot would then be further from the hole into which it is to be putted than it should be. Therefore, to insure that the marker 10 must be dropped over the ball 26, the opening 18 should have its arc 20 containing an angle a of over 180°. A complete circular opening (not shown) could be provided in the marker, but for size considerations, as angle a in the range of from approximately 210° to 270° has been found to be very satisfactory.

In the rules of golf as defined by the United States Golf Association, a golf ball is restricted as to its size which must be "not less than 1.680 inches in diameter", and this minimum size is generally used, but, there is an exception. The rules of golf as defined by the Royal and Ancient Golf Club of St. Andrews, Scotland, provides that a golf ball shall have a "size not less than 1.620 inches in diameter". Therefore, the radii 22 and 24 which determines the size of the opening 18 of the marker 10 should ideally be of one length for use with the larger 1.680 inch diameter ball and should be shorter for the smaller 1.620 inch diameter golf ball. It has been found that if each of the radii 22 and 24 are sized to be about 0.125 inches longer than the radius of the golf ball, the 0.125 inch clearance or gap, between the periphery of the ball and the arc 20 allows the marker 10 to be dropped over the ball without the need for precision placement and with a minimum chance of the marker coming into contact with, and unintentionally moving, the ball. Therefore, a marker which is to be used in marking the larger diameter golf ball should ideally have the lenght of the radii 22 and 24 at approximately 0.965 inches and a marker which is to be used with the smaller diameter ball should ideally have the length of the radii 22 and 24 at approximately 0.935 inches. However, for manufacturing and use considerations, a compromise has been found to work satisfactory. Such a compromise could be to size each of the radii 22 and 24 at approximately 0.950 inches which forms the opening 18 somewhat tighter than is ideal for the larger diameter ball without it being an excessively loose fit on the smaller diameter ball.

Figure 4:
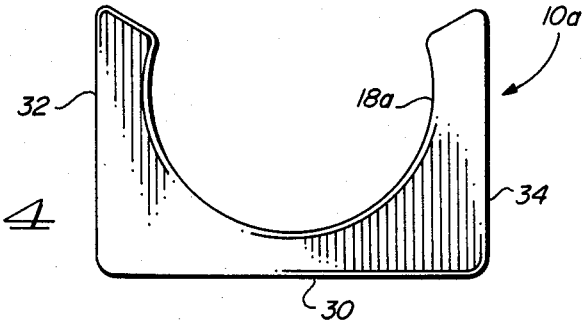
FIG. 4 is a plan view of a modification of the golf ball marker of the present invention.

In the preferred embodiment of the marker 10 as shown in FIGS. 1, 2 and 3, the peripheral configuration of the marker is shown as being the sector of a circle which matches the sector of the opening 18. This peripheral configuration is shown entirely for illustrative purposes in that the periphery can be of any convenient configuration such as that shown in the modified marker 10*a* in FIG. 4. In the marker 10*a*, the opening 18*a* may be identical to the above described opening 18 of the marker 10, and therefore, the only difference between the markers 10 and 10*a* is that the peripheral configuration of the marker 10*a* may be, for example, formed with a back linear edge 30 and opposed linear side edges 32 and 34, with the opening 18*1* opening away from the linear edge 30.

As hereinbefore mentioned, the intended usage of the marker 10 is that it be dropped vertically over the ball 26 onto the putting surface 28. When so placed over the ball, the marker 10 will define the spot of the ball from both the in-line distance from the hole (not shown) into which it is to be putted, by virtue of the location of the bight portion 12 of the marker, and will define the lateral position of the ball relative to the in-line direction of the ball by virtue of the oppositely disposed arms 14 and 16 of the marker. When the golf ball 26 is so marked, the ball can be lifted from the putting surface 28 and the marker 10 will precisely mark the spot upon which the ball is to be subsequently replaced. The marker 10 is highly visible due to its size and thus is easily seen by the golfers, the gallery, and the like.

In the preferred horeshoe like configuration of the marker 10, the total arcuate length of the bight portion 12 and the arms 14 and 16 is about six inches, and the width dimension is ideally about one-half inch. Therefore, the surface area of the marker 10 will be approximately three square inches on each of its opposite planar surfaces. This relatively large surface area, in addition to providing a high visibility factor for the marker 10, will also provide a substantial area for displaying suitable indicia (not shown) such as the owners name, event commemorating indicia, advertising, and the like.

When the golf ball location has been marked as hereinbefore described and lifted from the putting surface, the ball 26 is subsequently replaced by simply returning it to the center of the opening 18 of the marker 10. The marker 10 is then removed from the putting surface 28 by either lifting it vertically or by sliding it along the putting surface 28 until it is out from under the golf ball 26. The latter marker removal method is preferred in that it minimizes the chances of the ball marker coming into contact with the ball and unintentionally moving it during removal of the marker.

While the principles of the invention have now been made clear in the illustrated embodiments, there will be immediately obvious to those skilled in the art, many modifications of structures, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A marker for marking the position of a golf ball that is to be lifted from a putting green surface, said marker comprising a thin gage planar body including a first inner boundary defining a segment of a circle and a second outer boundary generally surrounding said first boundary, said segment defining an angle of greater than 180 degrees and less than 360 degrees, the size of said circle being such that said planar body may be moved vertically downwardly so as to pass closely over the golf ball to be marked onto the putting surface green to mark the position of the golf ball thereon, the thinness of said planar body being such that said planar body presents minimal obstruction to a putted golf ball rolling thereover.

* * * * *